United States Patent [19]

Kennings

[11] Patent Number: 4,591,074

[45] Date of Patent: May 27, 1986

[54] CAPLESS CONTAINER

[76] Inventor: Kenneth L. Kennings, Rte. 2, Box 83-4, Strafford, Mo. 65757

[21] Appl. No.: 466,536

[22] Filed: Feb. 15, 1983

[51] Int. Cl.[4] ..... B65D 83/04

[52] U.S. Cl. ..... 222/153; 222/160; 222/168; 222/183; 222/514

[58] Field of Search ..... 222/153, 160, 162, 183, 222/514, 511, 522, 524, 541, 519; 221/287

[56] References Cited

U.S. PATENT DOCUMENTS

| | | | |
|---|---|---|---|
| 149,833 | 4/1874 | Brown | 222/162 X |
| 981,333 | 1/1911 | Vance | 222/162 X |
| 1,483,401 | 2/1924 | Wolcott | 222/514 |
| 1,859,126 | 5/1932 | Boeuf | 222/519 X |
| 2,601,061 | 6/1952 | Schwartz | 222/514 X |
| 3,095,128 | 6/1963 | Wonso | 222/524 X |
| 3,419,190 | 12/1968 | Kauffman et al. | 222/160 X |
| 3,658,218 | 4/1972 | Krautkramer | 222/522 |
| 4,007,857 | 2/1977 | Tomiati et al. | 222/153 |
| 4,128,192 | 12/1978 | Coryell | 222/541 X |
| 4,205,766 | 6/1980 | White | 222/153 X |

FOREIGN PATENT DOCUMENTS

| | | | |
|---|---|---|---|
| 915586 | 1/1963 | United Kingdom | 222/513 |

*Primary Examiner*—Joseph J. Rolla
*Assistant Examiner*—Frederick R. Handren
*Attorney, Agent, or Firm*—Berman, Aisenberg & Platt

[57] ABSTRACT

A container comprises a hollow outer element and an inner element. The inner element is mounted for movement within the hollow portion of the outer element and is also hollow to contain articles. The inner element has a hole in one end to permit the articles to be dispensed when the inner element extends from the outer element. The contents are retained in the inner element when the hole is covered by the outer element. A control mechanism causes the inner element to extend from the outer element when the container is in the open position, holds the inner element so that the hole is covered by the outer element in a closed position and holds the inner element in a third, locked position.

11 Claims, 13 Drawing Figures

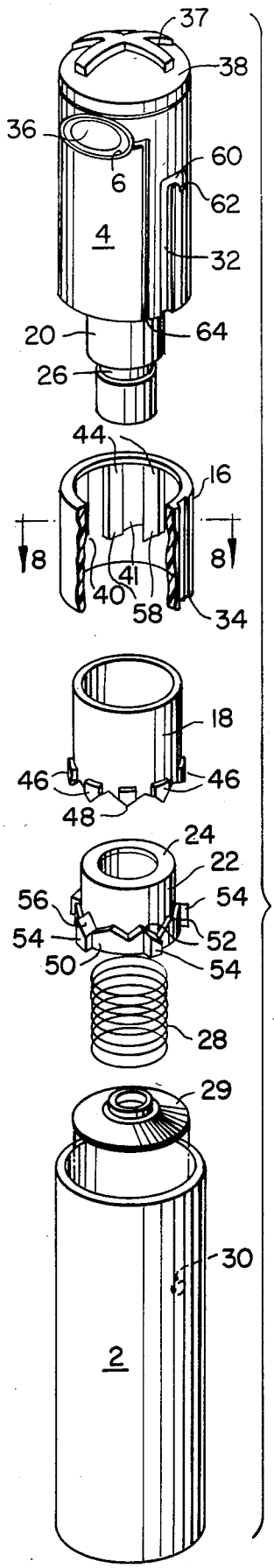
FIG. 7.
FIG. 8.
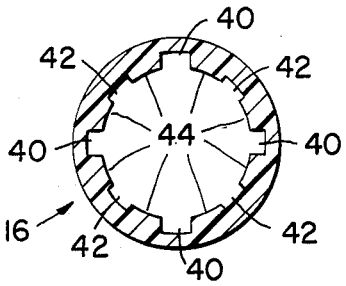
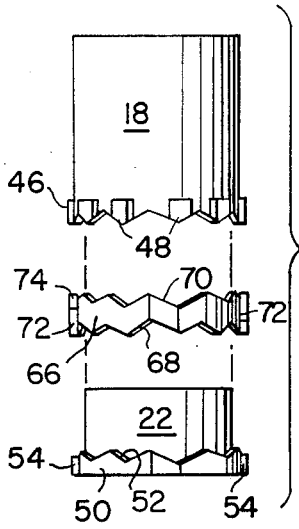
FIG. 10.
FIG. 13.
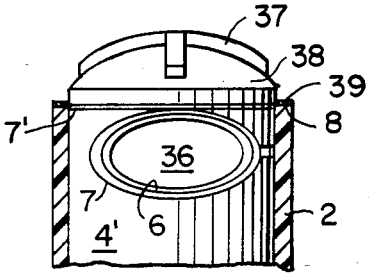
FIG. 12.
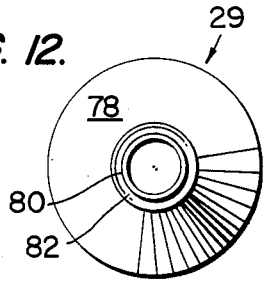
FIG. 9.
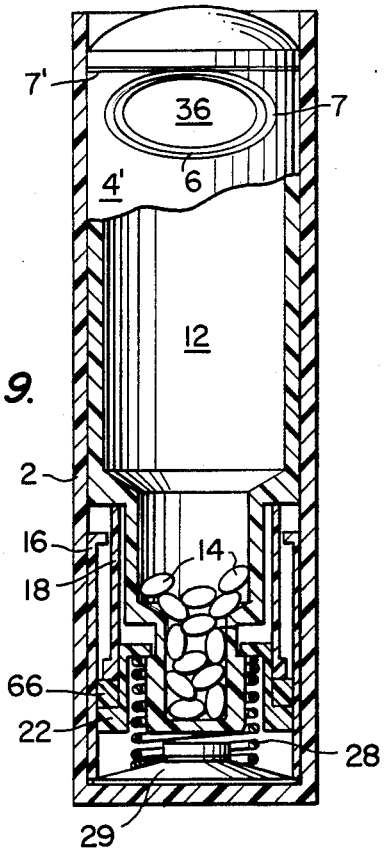
FIG. 11.
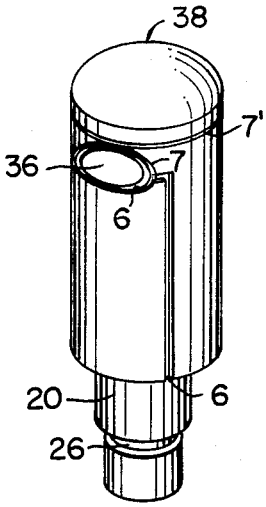

CAPLESS CONTAINER

TECHNICAL FIELD

This invention relates to the art of containers, and particularly to the art of capless containers for use in dispensing medicine.

BACKGROUND ART

Containers which have caps for allowing an opening to be covered or uncovered are known in the art. These containers come in a variety of shapes and sizes, and are used for a variety of materials. A body portion typically serves to contain the material being stored and also provides an opening, such as a threaded neck, for attaching a cap. Many of these containers are designed to be child-proof by providing caps which must be manipulated in a particular fashion in order to be removed.

For example, U.S. Pat. Nos. 3,200,979 (Powers), 3,276,612 (Caldwell), 3,426,930 (Hershler) and 3,447,709 (Morasko) teach medicine containers having safety caps to prevent a child from opening the container.

While many of these containers may be successful in preventing children from gaining access to the contents, they also prevent adults who may be arthritic or paralyzed from opening the containers. Thus, these types of containers have limited usefulness since they cannot be used by adults unable to open them. At the same time, a container which may be opened by an arthritic adult may be accessible to a child thus exposing him to the danger inherent in such a container.

Many other containers also require a locking mechanism to prevent easy access to the contents. For example, a container of food may be in the presence of an animal to be fed so that it is necessary to have a mechanism for preventing the animal from opening the container.

SUMMARY OF THE INVENTION

The present invention provides a container which does not require a cap, and which is child resistant and tamper proof. The preferred embodiment of the invention is to dispense medicines, but it will be clear from the following specification that the container may be designed for a variety of uses and may be of almost any size.

The inventive container comprises an outer element which is hollow and open at one end. An inner element is mounted within the hollow portion of the outer element for axial movement along the hollow portion. One end of the inner element has an opening for removing the contents. The portion of the inner element having the opening may extend beyond the upper edge of the outer element to allow the contents of the container to be dispensed. The container is closed by placing the inner element within the hollow element so that the opening of the inner element is below the upper edge of the outer element. O-ring type seals on the inner element seal the inner element to the outer element. A child resistant feature is provided by a third position of the inner element which is obtained by depressing the inner element past the closed position to a locked position.

In a first embodiment of the invention, a ratchet mechanism operates to allow the opening of the inner element to extend beyond the upper edge of the hollow element and to secure the inner element so that the opening is below the upper edge. An elastic element between the outer element and the inner element holds the container in the open position and the inner element is placed in the closed position by applying force to the top of the inner element. In a first embodiment, the inner element has a hook-like groove which cooperates with a protuberance on the inner surface of the hollow element so that when the inner element is moving between the open and closed positions, the protuberance merely rides along the groove. When it is desired to lock the container closed, the container is pushed down to allow the protuberance to engage the hook portion of the groove and the inner element is rotated slightly to seat the protuberance in the hook portion. The container is opened by rotating the inner element to remove the protuberance from the hook portion of the groove to again allow the protuberance to slide along the groove.

In a second embodiment of the invention, a novel dual ratchet mechanism is employed in such a manner that the inner element operates between the open and closed positions which one ratchet, while a second ratchet operates to secure the inner element in the locked position. In this embodiment, no rotation is required to lock the inner element, it being necessary merely to depress the inner element beyond the closed position to activate the second ratchet.

In both the first and second embodiments, an elastic element is employed to continually urge the inner element toward an open position. The elastic element, which may be a coil spring, produces a stronger force when the inner element is in the locked position than when it is in the open or closed position. In one embodiment, a first spring supplies the force required for opening and closing, and a second elastic element supplies a locking force. The container is designed so that the force produced by the elastic element in the locked position is large enough to prevent a child from depressing the inner element to unlock it.

In a third embodiment, the container employs both locking mechanisms described above to provide a double-locked container.

Two tamper-proof features are employed. The opening in the inner element has a first tamper-proof seal which must be broken to gain access to the contents. In addition, a flange is attached to the inner element when in the locked position, and this flange must be broken to open the container.

BRIEF DESCRIPTION OF THE DRAWINGS

FIG. 7 is an exploded diagram of the invention.

FIG. 8 is a cross-section of a grooved element taken along line 8—8 of FIG. 7.

FIG. 9 is a cross-section of a second embodiment of the invention.

FIG. 10 is an exploded diagram of the central elements of the invention shown in FIG. 9.

FIG. 11 is a perspective of the inner element of the invention shown in FIG. 9.

FIG. 12 is a plan view of a locking disk.

FIG. 13 is a partial cross-section showing a tamper-proof flange.

DETAILED DESCRIPTION OF THE INVENTION

Figure 1:
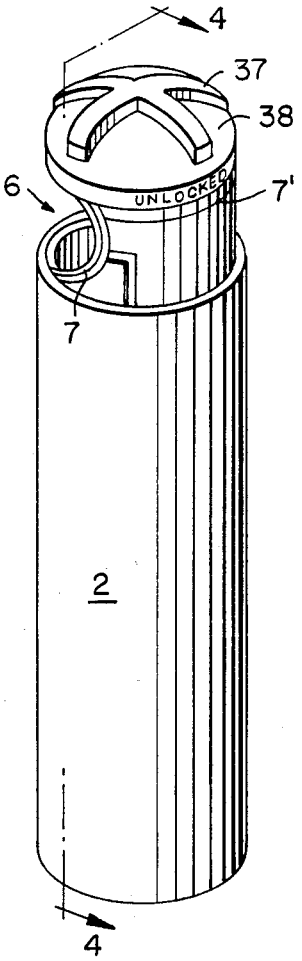
FIG. 1 is a perspective of a first embodiment of the invention in the opened position.

FIG. 1 shows an outer element 2 and an inner element 4. The inner element 4 is received in a hollow bore of the outer element 2 and moves axially along an axis of the bore. The inner element 4 is also hollow to contain material. An upper portion of the inner element 4 has an opening 6 for allowing the material held by the inner element 4 to be dispensed. An o-ring 7 encircles opening 6 to seal the opening against the outer element when in the closed position. A second o-ring 7' encircles inner element 4 to provide a double seal.

Figure 2:
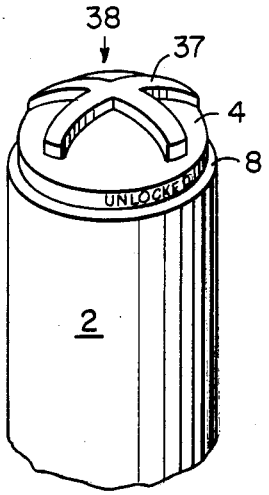
FIG. 2 is a perspective of a portion of the invention in the closed but unlocked position.

FIG. 2 shows the relationship between the outer element 2 and the inner element 4 in a closed position whereby the portion of the inner element 4 having the opening 6 is below the upper edge 8 of the outer element 2. This means that the opening 6 will be adjacent an inner wall of the element 2 to effectively close the container and the o-ring 7 will provide a seal.

Figure 3:
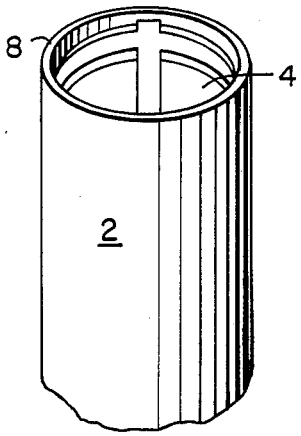
FIG. 3 is a perspective of a portion of the invention in the locked position.

FIG. 3 shows the relationship between the inner element 4 and the outer element 2 when the container is in the locked position. While FIG. 3 shows the top of the inner element 4 below the upper edge 8 of the outer element, it may be that it is desired to have the top of the inner element protrude slightly above the upper edge 8 in the locked position.

Figure 4:
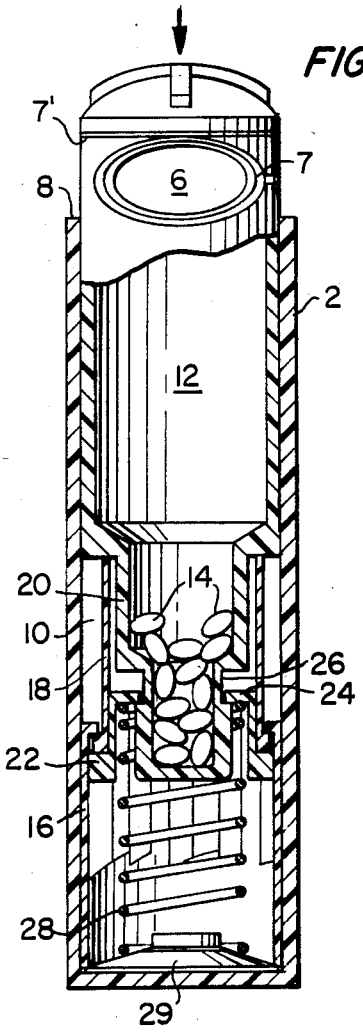
FIG. 4 is a cross-section of the invention along line 4—4 of FIG. 1.

FIG. 4 shows the relationships among the elements in the opened position. The outer element 2 has a hollow bore 10 which is designed to closely match the exterior configuration of the inner element 4. The inner element 4 includes a chamber 12 for receiving articles 14. These may be pills or capsules if the container is used for medicine, or they may be any other articles depending upon the size and use of the container.

A grooved element 16 fits tightly within the hollow bore 10 of the outer element 2. The grooved element 16 has two sets of grooves which will be described thoroughly with respect to FIG. 7. A plunger 18 fits around an extension 20 of the inner element and will move downwardly with downward movement of the inner element. A ratchet 22 is carried by the extension 20 and will thus move upwardly and downwardly with motion of the inner element. A lip 24 of the ratchet 22 fits within an annular recess 26 on the extension 20 so that the ratchet 22 serves to secure the inner element in the closed and locked positions. A spring 28, which may be any of a variety of elastic force elements, is positioned between the bottom of the outer element 2 and the bottom of lip 24 of ratchet 22 to provide a force on the ratchet which is dependent upon the position of the inner element with respect to the outer element.

A flexible disk 29 rests on the bottom of outer element 2. The disk does not contact the inner element 4 in the open or closed positions. When inner element 4 is depressed into the locked position, however, disk 29 contacts inner element 4 to require additional force to unlock the container. Disk 29 will be more fully described below with respect to FIG. 12. It will be appreciated that the disk could be replaced by a second spring co-axial with, but shorter than, spring 28. Also, disk 29 may be moulded as an integral part of the outer element.

Figure 5:
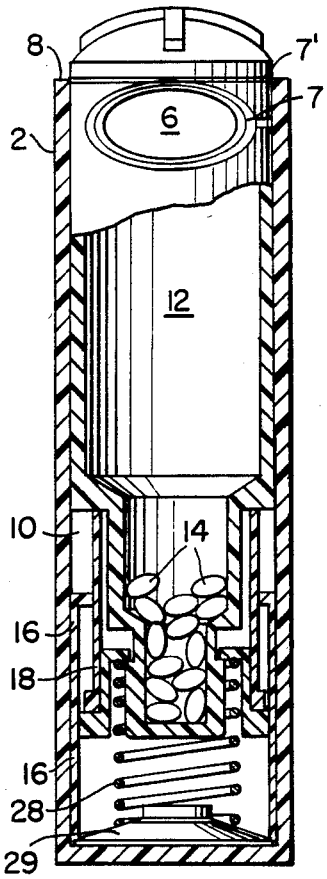
FIG. 5 is a cross-section of the invention when in the closed position of FIG. 2.

FIG. 5 shows the relative positions of the elements when the container is closed. It may be seen that the opening 6 is below the upper edge 8 of the outer element so as to cover the opening. As will be more fully described with respect to FIG. 7, means on the ratchet 22 interact with grooves in the element 16 to hold the inner element 4 in the position shown in position 5.

Figure 6:
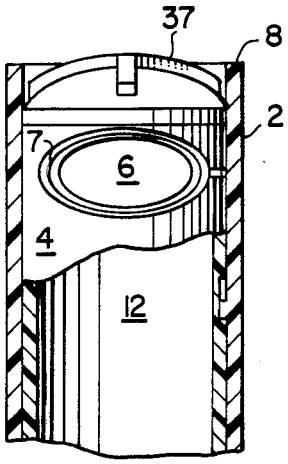
FIG. 6 is a partial cross-section of the invention in the locked position of FIG. 3.

FIG. 6 shows the container having the inner element 4 in the locked position.

FIG. 7 shows an exploded diagram of the first embodiment of the invention. Assembly is accomplished by first aligning ratchet 22, plunger 18, spring 28, disk 29, and grooved element 16 and by then sliding this aligned group of elements into the outer element 2. Grooved element 16 is designed to have a tight fit with the inner surface of the outer element 2, but if desired, a small amount of cement may be applied to secure grooved element 16 to the inner surface on outer element 2. Inner element 4 is then placed in the outer element 2. Annular recess 26 in the extension 20 will receive the lip 24 of the ratchet 22 by applying a force on inner element 4 to cause the lip 24 to snap into position in the annular recess 26. Disassembly may be accomplished by applying a force to inner element 4 to disengage the lip 24 from the annular recess 26. Thus the inner element 4 may be a disposable unit. A protuberance 30 extends from the inner surface of the element 2 for cooperation with the hook-shaped groove 32 in the inner element 4, and grooved element 16 has a slot 34 on its outer surface to allow the grooved element to slide beyond the protuberance 30 during assembly.

It will be understood by those having skill in the moulding arts that several of these elements could be combined. For example, the grooved element 16 could be an integral part of the outer cylinder, and the elements 18 and 22 could be slightly tapered to allow them to be pushed past the lip of element 16. It may also be desirable to make plunger 18 integral with inner element 4 for the second embodiment shown in FIG. 9.

Inner element 4 has a tamper-proof seal 36 which is preferably formed with the molding of the inner element 4. This cover is attached to the remainder of the inner element by a thin membrane of the plastic material, and it is removed by pressing the cover inwardly to sever the thin membrane.

The tamper-proof seal permits the first user of the container to immediately ascertain whether the contents have been adulterated. The seal is not replaceable so that once it has been broken, the container will not be mistaken for an unused container. If the container is to be used as a medicine dispenser, the inner element 4 may be molded with the tamper-proof seal intact, but with the top 38 of the inner element being detachable from the remainder of the element. The pharmaceutical company would load the inner element 4 with capsules or pills and would seal the top 38 to the remainder of the inner element 4 to produce a sealed container that could not be opened without leaving a clear indication that it had been previously opened. The user would simply punch out the seal to use the container.

Grooved element 16 has a first set of grooves 40 and a second set of grooves 42. The grooves 40 are radially deeper than the grooves 42, and the bottom portions of intermediate ridges 44 are slanted to cooperate with ratchet 22 in a manner to be described below. Each of the grooves 40 is located between a pair of grooves 42 so that the deep grooves alternate with the shallow grooves.

Plunger 18 has radially extending tabs 46 which are adapted to slide in both the first and second sets of grooves 40 and 42 so that the plunger 18 does not rotate but rather moves only in an axial direction. The bottom edge of the plunger 18 contains a plurality of teeth 48 for cooperation with teeth on the ratchet 22.

Ledge 50 extends from the outer surface of ratchet 22 and has teeth 52 which cooperate with teeth 48 on the plunger 18. Ratchet 22 also has radially extending projections 54 which ride only in the first set of grooves 40. The upper surfaces 56 of the projections 54 are slanted to cooperate with the slanted bottoms 58 on the intermediate ridges 44 to rotate the ratchet.

Tabs 46 and projections 54 are arranged so that teeth 48 and 52 are oriented almost peak-to-peak when the tabs and projections are riding in the grooves.

The operation of the first embodiment of the container can now be described with particular reference to FIGS. 4, 5, and 7. In the open position shown in FIG. 4, the projections 54 will be located in the first set of grooves 40, and the spring 28 will urge the inner element 4 outwardly until the radially extending tabs 46 are restrained by the lip on the grooved element 16. As the plunger is depressed, the projections 54 will move below the intermediate ridges 44 and the interaction of the teeth 48 and 52 will cause the ratchet 22 to rotate such that the slanted upper surfaces 56 of the ratchet 22 catch on the slanted surfaces 58 of the grooved element 16. As the pressure is released from the inner element 4, the interaction of the slanted surfaces 56 and 58 will cause the ratchet 22 to rotate into such a position that projections 54 are caught at the bottom edge 41 of groove 42. This position is shown in FIG. 5 and is the closed position of the container. If it is desired to open the container, one merely pushes down on the inner element 4 so that the teeth 48 interact with the teeth 52 to cause the ratchet 22 to rotate to again allow the slanted surfaces 56 to interact with slanted surfaces 58 causing the projections to ride in deeper grooves 40, thus allowing the inner element to again assume the position shown in FIG. 4. During the opening and closing operations, the protuberance 30 is riding in the linear portion of the hook-shaped groove 32.

The container is locked, to prevent its being opened by a child, by depressing the inner element 4 past the closed position shown in FIG. 5 and rotating it slightly. This allows the protuberance 30 to engage the horizontal portion 60 of the hook-shaped groove 32 and to come to rest in the tip 62 of the hook-shaped groove 32. The container is unlocked by depressing the inner element slighty to remove the protuberance 30 from the tip 62 and then by rotating the inner element to allow the protuberance 30 to slide in linear portion of the groove 32. A raised pattern 37 facilitates rotation of the inner element. It may also be designed so that the top of the inner element extends beyond upper edge 8 in the locked position. In this case, the top 38 would be knurled.

It is thus seen that the first embodiment of the container is operated by simply pushing to open, pushing to close, and pushing with a slight rotation to lock. These operations may be easily performed by disabled or arthritic persons, but the unlocking operation may not be performed by a child. It should also be noted that as the spring 28 is compressed, the force required to depress the inner element 4 increases. When the bottom of inner element 4 engages disk 29 the required force is such that a young child may be unable to even depress the cylinder 4 in the locked position in addition to being unable to combine the operations of pressing and rotating. In a preferred embodiment, the force produced by spring 28 is about 14 ounces, whereas the force produced by disk 29 is about 20 pounds.

Inner element 4 also has an air slot 64 to prevent a vacuum from being caused by movement of the element 4 within the outer element 2.

FIG. 8 shows a cross section of the grooved element 16 to illustrate how the grooves 40 are radially deeper than the grooves 42 and to show their relative positions throughout the circumference of the element 16.

The second embodiment of the container of the invention will now be described with respect to FIGS. 9, 10, and 11.

FIG. 9 shows the second embodiment of the invention in the locked position, and the configurations in the open and closed positions are similar to those shown in FIGS. 4 and 5. The second embodiment employs a plunger 18 and a ratchet 22 which are essentially identical to those employed in the first embodiment and shown in FIG. 7. An intermediate ring 66 fits between the plunger 18 and the ratchet 22 to provide the locking function. Intermediate ring 66 has a first set of teeth 68, a second set of teeth 70, and a second set of projections 72. The first set of teeth 68 cooperate with the teeth 52 on the ratchet 22 so that the ratchet has an operation identical to that described with respect to the first embodiment.

The locking function of the second embodiment is provided by the ratchet operation of intermediate ring 66 wherein the projections 72 operate in the same manner as the projections 54 in that they ride only in the deeper grooves 40. As the inner element 4' is depressed past the closed position, the second projections 72 will extend beyond the bottom of intermediate ridges 44, and the interaction between teeth 48 and teeth 70 will cause the inner ring 66 to rotate, thus allowing the slanted surfaces 74 on the projections 72 to rotate the intermediate ring 66. In this position, the projections 72 will be held at the bottom edge 41 of grooves 42 in a manner similar to that described above with respect to the projections 54 when the container is in the closed position. The difference is that the inner element 4' will be depressed by an amount equal to the thickness of the intermediate ring 66. This additional depression will cause the spring 28 to be additionally compressed and will result in a greater force required to depress the inner element 4'. Unlocking is accomplished by simply depressing the element 4' which in turn rotates intermediate ring 66 by the cooperation of teeth 48 with teeth 70 and aligns projection 72 with deeper grooves 40, thus allowing the inner element 4' to be pushed outwardly by the spring 28. The unlocking operation is difficult for a child because of the increased spring tension but is easily accomplished by an arthritic adult.

FIG. 11 shows the inner element 4' which is used with the second embodiment. Many of the components of this inner element have been described above. The primary difference is that the hook shaped groove 32 is not necessary because the locking is provided by the intermediate ring 66. In addition, the raised pattern shown in FIGS. 1 through 7, which facilitates rotating the inner element 4, is not necessary because no rotation of the inner element 4' is required in any of the opening, closing or locking operations of the second embodiment.

It is also an alternative embodiment to combine the locking operations of the intermediate ring 66 and the protuberance groove combination 30 and 32. This would provide a double-locked container useful for hazardous materials.

FIG. 12 shows locking disk 29. The disk has a conical portion 78 and a cylindrical neck portion 80. A groove 82 is cut into the conical portion to allow the disk to flex. In a preferred embodiment the conical portion is 0.030 inches thick, and the groove is 0.015 inches thick. The disk provides a snapping action to the locking operation in addition to supplying additional, locking force.

FIG. 13 shows a second tamper-proof feature. Top 38 has an annular flange 39 at a position such that it engages upper edge 8 when in the closed position. Thus, the pharmaceutical house may place the container in the closed position and load the inner element with medicine. The top 38, including the flange 39 would then be sealed to the inner element, for example by a cement. The container must be opened by depressing inner element 4, and this operation necessitates braking flange 39 away from the top 38. The purchaser can thus immediately determine whether the container has been opened.

A novel container has thus been described which is very easy to operate and contains a unique locking feature. The container may be used for medicine since it will be easily operated by an arthritic or disabled patient and yet will be child-resistant. Furthermore, a tamper-proof tab is provided to prevent adulteration of the medicine within the container.

It should be understood, however, that the container may be any appropriate size for containing a wide variety of articles. While the container is preferably made of molded plastic, it may be made of almost any material. The container has been described with reference to a spring 28, but it should be understood that any sort of elastic power source may be used instead of a spring.

It is claimed:

1. A container comprising an outer element and an inner element, said outer element having a bore for receiving said inner element for axial slidable movement therein and said inner element having a chamber for receiving articles and an opening for dispensing said articles, and control means for controlling the relative positions of said inner and outer elements, said control means comprising resilient means for biasing said inner element in a first direction to an open position wherein said opening is exposed and holding means for holding said inner element against the bias of said resilient means in a closed position wherein said opening is blocked by said outer element, wherein said holding means comprises means for releasing said inner element from said closed position when said inner element is pushed against the bias of said resilient means in a second direction opposite said first direction from said closed position and for again holding said inner element in said closed position when said inner element is subsequently pushed in said second direction from said open position.

2. A container according to claim 1 wherein said means for holding comprises grooves on an inner surface of said outer element and a ratchet means carried by said inner element, said ratchet means having projections thereon for engaging said grooves.

3. The container of claim 2 wherein said ratchet means comprises first means for movement along the axis of said bore without rotation and second means for rotation about said axis, a first rotation position of said second means enabling the holding of said inner element in said closed position, and a second rotational position of said second means enabling the releasing of said inner element from said closed position to said open position.

4. A container according to claim 2 further comprising locking means, said locking means comprising means for holding said inner element in a locked position spaced from said closed position.

5. A container according to claim 4 wherein said locking means comprises a groove on an outer surface of said inner element and a protuberance on an inner surface of said outer element for engaging said groove on said inner element, said groove having a transversely extending portion whereby said inner element is placed in said locking position by rotation of said inner element.

6. The container of claim 5 wherein the top of said inner element has a raised pattern for facilitating rotation of said inner element.

7. The container of claim 4 further comprising means for applying an additional bias to said inner element in said first direction when said inner element is in said locked position.

8. The container of claim 1 wherein said opening is covered with a tamper-proof seal.

9. A container according to claim 1 further comprising a frangible element which is in contact with said inner and outer elements when said inner element is in said closed position, whereby said frangible element must be broken during movement of said inner element to said open position.

10. A container according to claim 1 wherein said inner element is separable from said outer element whereby said inner element is disposable.

11. A container according to claim 4 wherein said locking means comprises a second ratchet carried by said inner element, said second ratchet having second projections for engaging said grooves on said outer element when said inner element is in said locked position.

* * * * *

UNITED STATES PATENT AND TRADEMARK OFFICE

CERTIFICATE OF CORRECTION

PATENT NO. : 4,591,074

DATED : May 27, 1986

INVENTOR(S) : Kenneth L. Jennings

It is certified that error appears in the above—identified patent and that said Letters Patent is hereby corrected as shown below:

Title Page, under Inventor, change the inventor's name to --Kenneth L. Jennings--.

Signed and Sealed this

Twenty-fifth Day of November, 1986

*Attest:*

DONALD J. QUIGG

*Attesting Officer* *Commissioner of Patents and Trademarks*